US007883365B2

(12) United States Patent
Saitou

(10) Patent No.: US 7,883,365 B2
(45) Date of Patent: Feb. 8, 2011

(54) RESILIENT PLUG AND A WATERPROOF CONNECTOR

(75) Inventor: Takahiko Saitou, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/551,986

(22) Filed: Sep. 21, 2009

(65) Prior Publication Data

US 2010/0075523 A1 Mar. 25, 2010

(30) Foreign Application Priority Data

Sep. 22, 2008 (JP) ..... 2008-243278

(51) Int. Cl.
*H01R 13/40* (2006.01)

(52) U.S. Cl. ..... 439/587

(58) Field of Classification Search ..... 439/587, 439/274, 275, 279, 589
See application file for complete search history.

(56) References Cited

U.S. PATENT DOCUMENTS

| | | | | | |
|---|---|---|---|---|---|
| 2,211,780 | A | * | 8/1940 | Jacobs | 361/510 |
| 2,465,175 | A | * | 3/1949 | Schwarz et al. | 277/562 |
| 4,560,219 | A | * | 12/1985 | Chapelot | 439/587 |
| 4,643,506 | A | * | 2/1987 | Kobler | 439/271 |
| 5,035,638 | A | * | 7/1991 | Kourimsky | 439/275 |
| 5,201,667 | A | * | 4/1993 | Endo et al. | 439/189 |
| 5,224,875 | A | * | 7/1993 | Watanabe et al. | 439/587 |
| 5,352,126 | A | * | 10/1994 | Kuboshima et al. | 439/89 |
| 5,458,507 | A | * | 10/1995 | Colescott et al. | 439/589 |
| 5,540,450 | A | * | 7/1996 | Hayashi et al. | 277/607 |
| 5,564,946 | A | * | 10/1996 | Kodama | 439/587 |
| 5,603,637 | A | | 2/1997 | Matsuoka et al. | |
| 5,662,336 | A | | 9/1997 | Hayashi | |
| 5,720,487 | A | * | 2/1998 | Kato | 277/637 |
| 5,824,962 | A | * | 10/1998 | Katsuma | 174/135 |
| 6,039,603 | A | * | 3/2000 | Wakata et al. | 439/587 |
| 6,764,329 | B2 | * | 7/2004 | Noguchi et al. | 439/273 |
| 6,840,804 | B2 | * | 1/2005 | Murakami et al. | 439/587 |
| 7,033,215 | B2 | * | 4/2006 | Kobayashi | 439/587 |
| 7,147,500 | B2 | * | 12/2006 | Tabata et al. | 439/274 |
| 7,371,114 | B2 | * | 5/2008 | Tanaka | 439/587 |
| 7,473,129 | B2 | * | 1/2009 | Jackson et al. | 439/589 |
| 7,553,186 | B2 | * | 6/2009 | Morikawa et al. | 439/587 |
| 2001/0049226 | A1 | * | 12/2001 | Murakami et al. | 439/587 |
| 2004/0106316 | A1 | * | 6/2004 | Noguchi et al. | 439/272 |
| 2005/0042906 | A1 | * | 2/2005 | Tabata et al. | 439/274 |
| 2007/0117441 | A1 | * | 5/2007 | Tanaka | 439/275 |
| 2007/0287329 | A1 | * | 12/2007 | Jackson et al. | 439/587 |

* cited by examiner

*Primary Examiner*—T C Patel
*Assistant Examiner*—Vladimir Imas
(74) *Attorney, Agent, or Firm*—Gerald E. Hespos; Michael J. Porco

(57) ABSTRACT

A waterproof connector (10) has a terminal fitting (30) connected with an end of a wire (60). A resilient plug (40) is mounted on the end of the wire (60) and has a main body (42) held onto the wire (60) by the terminal fitting (30). A housing (20) has a cavity (21) into which the terminal fitting (30) and the resilient plug (40) are inserted. Outer lips (46) project on the outer circumferential surface of the main body (42) and are held resiliently in close contact with the inner circumferential surface of the cavity (21). Auxiliary lips (47) with a smaller projecting amount than the outer lips (46) also project on the outer circumferential surface of the main body (42). The outer lips (46) and the auxiliary lips (47) are arranged to lean against each other if the wire (60) is shaken.

8 Claims, 2 Drawing Sheets

RESILIENT PLUG AND A WATERPROOF CONNECTOR

BACKGROUND OF THE INVENTION

1. Field of the Invention

The invention relates to a resilient plug and to a waterproof connector.

2. Description of the Related Art

U.S. Pat. No. 7,033,215 B2 discloses waterproof connector and resilient plug. This plug has a main body to be mounted on an end of a wire and held on the wire by a terminal fitting. Lips project on the outer circumferential surface of the main body. The lips are held resiliently in close contact with an inner circumferential surface of a cavity in a connector housing to seal the interior of the cavity in a watertight manner.

Aluminum wires that are shaken change in shape more easily than copper wires and are less likely to restore to an initial state. Thus, the resilient plug is deformed in a wire shaking direction and the lips that project in the shaking direction may be compressed excessively against the facing inner circumferential surface of the cavity. The lips that project in a direction opposite to the shaking direction may be separated from the facing inner circumferential surface of the cavity to impair sealing ability.

The invention was developed in view of the above situation and an object thereof is to enable sealability to be ensured even if a wire is shaken.

SUMMARY OF THE INVENTION

The invention relates to a resilient plug with a main body to be mounted on an end of a wire. The plug can be inserted into a cavity of a housing together with a terminal fitting. At least one lip projects on the outer circumferential surface of the main body and can be held resiliently in close contact with the inner circumferential surface of the cavity. At least one auxiliary lip also projects on the outer circumferential surface of the main body, but has a smaller projecting amount than the lip. The lip and the auxiliary lip are arranged to lean against each other when the wire is shaken. The lip receives a reaction force from the auxiliary lip when the wire is shaken, and hence can retain a specified shape. Accordingly, parts of the lip that project in a shaking direction of the wire are not compressed excessively against the facing inner circumferential surface of the cavity and parts of the lip at an opposite side in the shaking direction are not separated from the inner circumferential surface of the cavity. As a result, sealing ability in the cavity is ensured.

The main body of the plug preferably is held on the wire by the terminal fitting.

The auxiliary lip preferably does not touch the inner circumferential surface of the cavity when the resilient plug is inserted into the cavity. Thus, the auxiliary lip does not contribute to insertion resistance as the resilient plug is being inserted into the cavity and resilient plug can be inserted easily.

The lip preferably has a substantially flat cross section with a dimension in forward and backward directions that exceeds a radial dimension.

One or more inner lips preferably project from the main body towards the wire.

The lips and the inner lips preferably are arranged at different positions in forward and backward directions.

The plug preferably has at least two lips and at least two auxiliary lips. Thus, only the rearmost lip and the auxiliary lip adjacent thereto lean against each other when the wire is shaken. The second rearmost lip and the auxiliary lip adjacent thereto do not leaning against each other when the wire is shaken.

The invention also relates to a waterproof connector, comprising a housing formed with at least one cavity, at least one terminal fitting connected with an end of a wire and inserted into the cavity and at least one of the above-described resilient plugs mounted on the end of the wire. As described above, the lip and the auxiliary lip lean against each other when the wire is shaken. Thus, the lip receives a reaction force from the auxiliary lip when the wire is shaken and can be kept a specified shape. Accordingly, a part of the lip that projects in a shaking direction of the wire is not compressed excessively against the facing inner circumferential surface of the cavity and a part of the lip at an opposite side in the shaking direction is not separated from the inner circumferential surface of the cavity. As a result, sealing in the cavity is ensured.

The auxiliary lip preferably does not touch the inner circumferential surface of the cavity when the resilient plug is inserted in the cavity. Thus, the auxiliary lip does not contribute to insertion resistance when the plug is being inserted into the cavity and hence the plug can be inserted easily.

These and other objects, features and advantages of the present invention will become more apparent upon reading of the following detailed description of preferred embodiments and accompanying drawings. It should be understood that even though embodiments are separately described, single features thereof may be combined to additional embodiments.

BRIEF DESCRIPTION OF THE PREFERRED EMBODIMENTS

DETAILED DESCRIPTION OF THE PREFERRED EMBODIMENTS

Figure 1:
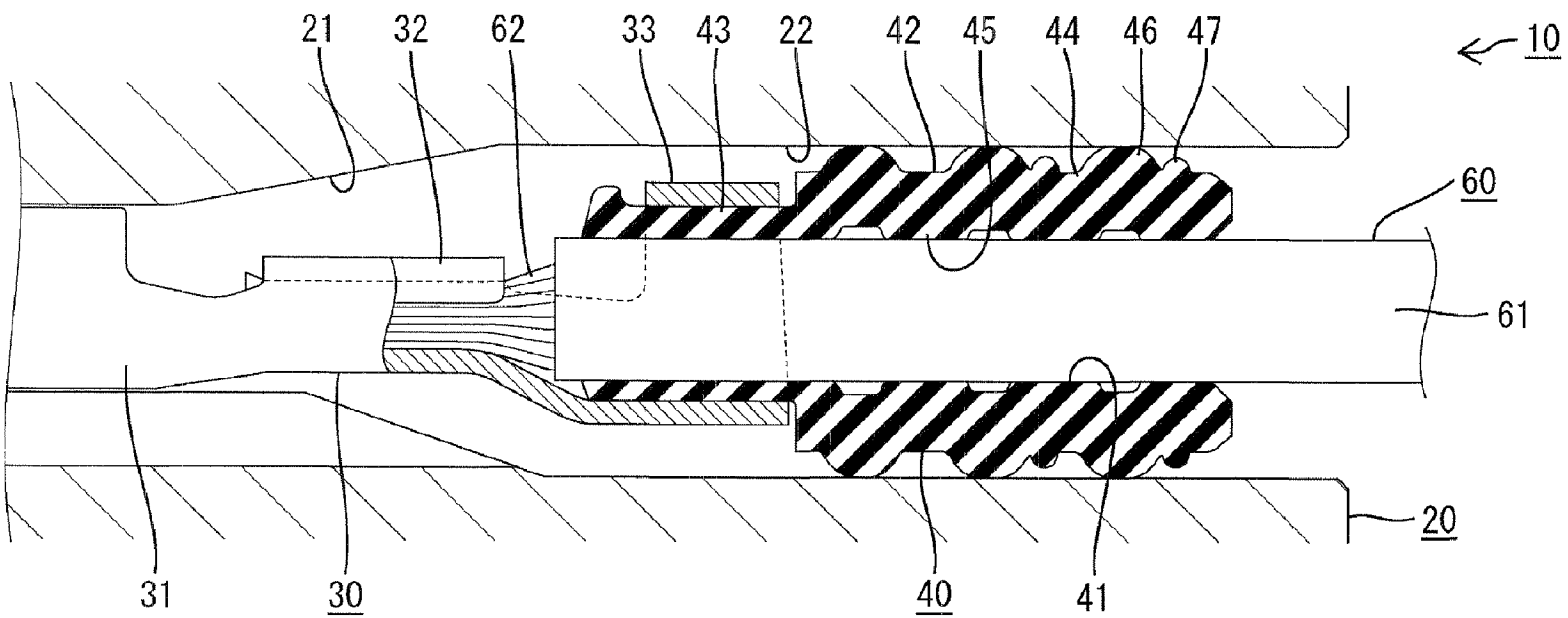
FIG. 1 is a section showing an essential part of a waterproof connector according to one embodiment of the present invention.
Figure 2:
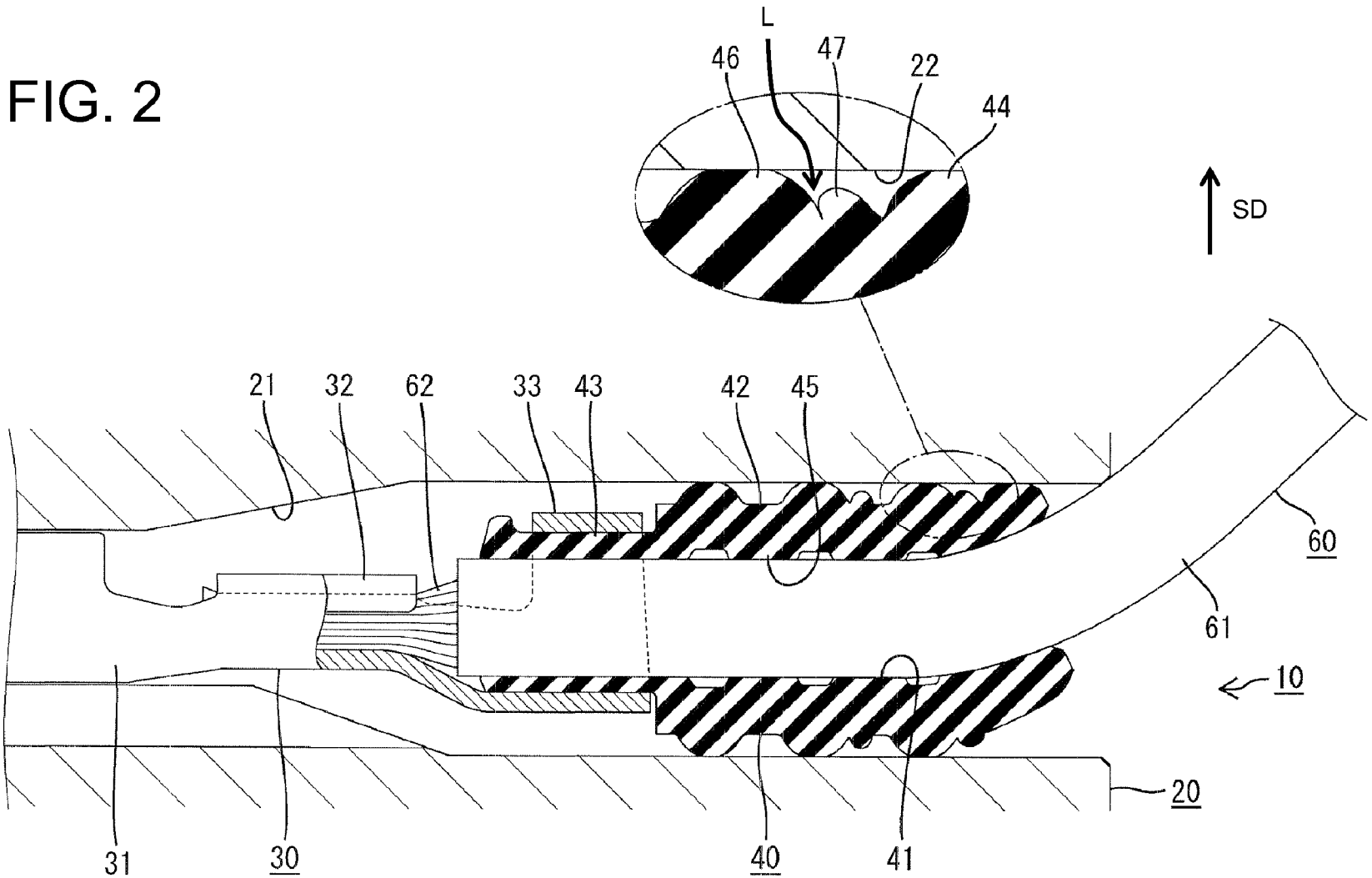
FIG. 2 is a section showing an essential part of the waterproof connector in a state where a wire is shaken.

A waterproof connector according to the invention is identified by the numeral 10 in FIGS. 1 and 2. The connector 10 has a housing 20, at least one terminal fitting 30 and a resilient plug 40 made of a resilient material, such as rubber.

The housing 20 is made e.g. of synthetic resin, and has a substantially block-shaped. The housing 20 is configured to connect with an unillustrated mating connector. At least one cavity 21 is formed in the housing 20 to extend substantially in forward and backward directions. The terminal fitting 30 and the resilient plug 40 are insertable into the cavity 21 of the housing 20 from behind. A resilient plug accommodating chamber 22 is defined at a rear portion of the cavity 21 and has an opening diameter larger than that of a front portion of the cavity 21.

The terminal fitting 30 is formed unitarily by applying bending, folding and/or embossing to an electrically conductive plate, such as a metal plate of copper or copper alloy. The terminal fitting 30 includes a substantially tubular connecting portion 31 that is connectable with a mating terminal fitting, a wire connection portion to be connected with a wire 60. At least one wire barrel 32 is located behind the connecting portion 31 and is configure to be crimped, bent or folded into connection with a core 62 of the wire 60 that has been exposed by stripping off an insulation coating 61 at an end portion of the wire 60. At least one insulation barrel 33 is located behind the wire barrel 32 and is configured to be crimped, bent or folded into connection with the resilient plug 40 mounted on the insulation coating 61 of the wire 60. The core 62 of the wire 60 preferably is formed by twisting a plurality strands made of aluminum or aluminum alloy. The insulation coating 61 preferably is made of resin and surrounds the core 62.

The resilient plug 40 is made unitarily of a resilient material and preferably of rubber, such as silicon rubber. The resilient plug 40 has a substantially cylindrical shape. A wire insertion hole 41 extends through the resilient plug 40 in forward and backward directions and is dimensioned for closely receiving the wire 60. Specifically, the resilient plug 40 includes a main body 42 that is long and narrow in forward and backward directions. A fastening portion 43 is formed at a front end of the main body 42 and has a cylindrical outer circumferential surface to be crimp-connected with the insulation barrel 33. A sealing portion 44 formed behind the fastening portion 43 and is to be held in contact with the wire 60 and the housing 20 in a watertight manner. The wire insertion hole 41 is substantially continuous from the fastening portion 43 to the sealing portion 44 and surrounded in the fastening portion 43 by the circumferential surface extending along the outer circumferential surface of the wire 60.

Circumferentially extending inner lips 45 project from the inner circumferential surface of the sealing portion 44 and are arranged at intervals in forward and backward directions. The inner lips 45 are held in close contact with the outer circumferential surface of the wire 60 with a specified compression margin. Circumferentially extending outer lips 46 project from the outer circumferential surface of the sealing portion 44 and are arranged at intervals in forward and backward directions. The outer lips 46 have a flat cross sectional shape with a dimension in forward and backward directions that is larger than a dimension in height or radial direction. More particularly, the outer lips 46 are dimensioned radially to be held in close contact with the inner circumferential surface of the resilient plug accommodating chamber 22 or the cavity 21 with a specified compression margin. The outer lips 46 and the inner lips 45 are arranged at different positions in forward and backward directions and hence do not register or align with one another in radial directions.

Circumferentially extending auxiliary lips 47 project out from the outer circumferential surface of the sealing portion 44 at positions immediately behind the respective outer lips 46 in forward and backward directions. The auxiliary lip 47 and the adjacent outer lip 46 in each pair are arranged continuously like two mountains on the outer circumferential surface of the sealing portion 44. Dimensions of each auxiliary lip 47 in forward and backward directions and in the height or radial directions are smaller than corresponding dimensions of the outer lips 46. Additionally, the radial dimensions of the auxiliary lips 47 are selected so that the auxiliary lips 47 do not contact the inner circumferential surface of the cavity 21 when the resilient plug 40 is being inserted into the cavity 21. If the wire 60 drawn out of the housing 20 is shaken, the auxiliary lips 47 lean against and engage the outer lips 46, as indicated at location L in FIG. 2. Thus, front surfaces of the auxiliary lips 47 contact with rear surfaces of the adjacent outer lips 46, as shown in FIG. 2, to exert reaction forces against each other. In other words, the outer rib 46 is deflected so that a portion thereof adjacent to the auxiliary lip 47 is deformed to engage a portion of the auxiliary lip 47 substantially facing the respective outer lip 46. Accordingly, the auxiliary lip 47 sustains the deformed outer lip 46 and increases the total amount of reaction force necessary to deform the resilient plug 40 further.

The wire barrel 32 is crimped, bent or folded into connection with the core 62 of the end portion of the wire 60 and the insulation barrel 33 is crimped, bent or folded into connection with the fastening portion 43 of the resilient plug 40 mounted on the insulation coating 61 of the end portion of the wire 60. Subsequently, the terminal fitting 30 is inserted into the cavity 21 of the housing 20 from behind along with the wire 60 and the resilient plug 40. The resilient plug 40 is accommodated in the resilient plug accommodating chamber 22 of the cavity 21 when the terminal fitting 30 is inserted to a proper depth, and the wire 60 is drawn out of the housing 20. The terminal fitting 30 then is connected electrically with a mating terminal fitting as the connector 10 is connected with the mating connector from the front.

The wire 60 drawn out of the housing 20 is likely to be shaken and may remain bent in a shaking direction SD, as shown in FIG. 2. Thus, a large compression force acts on the resilient plug 40 in the shaking direction SD of the wire 60. Parts of the outer lips 46 projecting substantially in the shaking direction SD of the wire 60 could be compressed excessively against the inner circumferential surface of the cavity 21 and parts thereof at an opposite side in the shaking direction SD could be separated from the inner circumferential surface of the cavity 21, thereby preventing a specified sealing ability.

However, the outer lips 46 and the auxiliary lips 47 lean against each other at the location L on a circumferential side of the resilient plug 40 substantially in shaking direction SD when the wire 60 is shaken. Rigidity in these leaning parts is increased and the outer lips 46 can maintain their specified properly compressed shapes by receiving reaction forces from the auxiliary lips 47. Thus, the parts of the outer lips 46 projecting substantially in the shaking direction SD of the wire 60 are not compressed excessively against the inner circumferential surface of the cavity 21 and, consequently, the parts of the outer lips 46 at the opposite side in the shaking direction SD are not separated from the inner circumferential surface of the cavity 21. As a result, proper sealing in the cavity 21 is ensured. In a state where the wire 60 is shaken into contact with the opening edge of the cavity 21, as shown in FIG. 2, only the rearmost outer lip 46 and the auxiliary lip 47 adjacent thereto lean against each other. The second rearmost outer lip 46 and the auxiliary lip 47 adjacent thereto remain substantially in the initial state before the shake of the wire 60 (or not leaning against each other). The second rearmost auxiliary lip 47 fulfills an auxiliary role, for example, in the case where the rearmost auxiliary lip 47 no longer functions properly.

The invention is not limited to the above described and illustrated embodiment. For example, the following embodiments are also included in the technical scope of the present invention.

The outer lips and the auxiliary lips may be arranged in contact with each other already before the wire is shaken.

The outer lips and the auxiliary lips may be arranged in proximity at a certain distance from each other before the wire is shaken.

The auxiliary lip may be provided only at the position corresponding to the rearmost outer lip.

The auxiliary lip may be provided at each of the positions corresponding to the respective outer lips.

The wire may be a copper wire including a core formed by twisting a plurality of strands made of copper or copper alloy.

The resilient plug may be mounted to any kind of terminal fitting including a male terminal fitting, a terminal fitting to be connected to a wire not by crimping such as an insulation displacement terminal fitting or the like.

What is claimed is:

1. A waterproof connector, comprising:

a housing formed with at least one cavity;

at least one terminal fitting connected with an end of a wire and disposed in the cavity; and at least one resilient plug having a front end, a rear end and a wire insertion hole extending between the ends, the wire being inserted through the wire insertion hole, a fastening portion adjacent the front end and being crimp-connected to the terminal fitting, a sealing portion rearward of the terminal fitting, the resilient plug being inserted in the cavity together with the terminal fitting in a rearward to forward direction so that the rear end of the resilient plug is in the cavity, at least one outer lip projecting on an outer circumferential surface of the sealing portion, the outer lip being dimensioned to be held resiliently in close contact with an inner circumferential surface of the cavity, and at least one auxiliary lip projecting on the outer circumferential surface of the main body at a position rearward of the outer lip and having a smaller projecting amount than the outer lip, radial dimensions of the auxiliary lip being dimensioned so that the auxiliary lip does not contact the inner circumferential surface of the cavity, the outer lip and the auxiliary lip being arranged to lean against each other when the wire is shaken.

2. The connector of claim 1, wherein the outer lip has a substantially flat cross sectional shape with a dimension in forward and backward directions is larger than a radial dimension thereof.

3. The connector of claim 2, further comprising inner lips projecting from the main body toward the wire.

4. The connector of claim 3, wherein the outer lips and the inner lips are arranged at different positions in forward and backward directions.

5. The connector of claim 4, wherein the at least one outer lip comprises front and rear outer lips and the at least one auxiliary lip comprises front and rear auxiliary lips, the outer lips and the auxiliary lips being provided so that in a state where the wire is shaken only the rear outer lip and the rear auxiliary lip lean against each other and the front outer lip and the front auxiliary lip do not lean against each other.

6. A resilient plug with opposite front and rear ends and a wire insertion hole extending between the ends, the resilient plug being insertable into a cavity that has an inner circumferential surface, the resilient plug comprising:

a fastening portion substantially adjacent the front end and having a substantially cylindrical outer surface;

a sealing portion rearward of the fastening portion, portions of the wire insertion hole along the main body being formed with a plurality of circumferentially extending inner lips spaced from one another in forward and backward directions;

first and second circumferentially extending outer lips projecting on an outer circumferential surface of the sealing portion at positions offset from the inner lips, the second outer lip being between the first outer lip and the rear end of the resilient plug, the outer lips each having dimensions in the forward and backward directions that exceed radial dimensions thereof and the radial dimension of the outer lips being selected to be held resiliently in close contact with the inner circumferential surface of eh cavity; and at least one circumferentially extending auxiliary lip projecting on the outer circumferential surface of the main body at a position rearward of and adjacent to the second circumferentially extending outer lip, the auxiliary lip having a smaller projecting amount than the second outer lip, radial dimensions of the auxiliary lip being dimensioned so that the auxiliary will not contact the inner circumferential surface of the cavity, the second outer lip and the auxiliary lip being dimensioned and disposed to lean against each other in response to transverse bending of the resilient plug.

7. The resilient plug of claim 6, wherein all areas of the resilient plug between the auxiliary lip and the rear end of the resilient plug have a diameter no greater than the auxiliary lip.

8. The connector of claim 1, wherein all areas of the resilient plug rearward of the auxiliary lip have a diameter no greater than the auxiliary lip.

* * * * *